US008022881B2

(12) United States Patent
Wong et al.

(10) Patent No.: US 8,022,881 B2
(45) Date of Patent: Sep. 20, 2011

(54) MULTIBAND ANTENNA

(75) Inventors: Kin-Lu Wong, Tapei Hsien (TW); Cheng-Tse Lee, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 378 days.

(21) Appl. No.: 12/403,462

(22) Filed: Mar. 13, 2009

(65) Prior Publication Data

US 2010/0149065 A1 Jun. 17, 2010

(30) Foreign Application Priority Data

Dec. 12, 2008 (TW) ..... 97148561 A

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/846, 848, 702
See application file for complete search history.

(56) References Cited

U.S. PATENT DOCUMENTS

| | | | | |
|---|---|---|---|---|
| 7,352,326 | B2 * | 4/2008 | Korva et al. | 343/700 MS |
| 2004/0085245 | A1 * | 5/2004 | Miyata et al. | 343/700 MS |
| 2004/0145527 | A1 * | 7/2004 | Mikkola | 343/700 MS |
| 2008/0122714 | A1 * | 5/2008 | Ishihara et al. | 343/750 |
| 2009/0174604 | A1 * | 7/2009 | Keskitalo et al. | 343/700 MS |

* cited by examiner

*Primary Examiner* — Hoanganh Le
(74) *Attorney, Agent, or Firm* — Alan Kamrath; Kamrath & Associates PA

(57) ABSTRACT

A multiband antenna comprises a ground plane, a substrate, and a radiating metal element, wherein a side of the substrate is substantially adjacent to a side of the ground plane; the radiating metal element is on a surface of the substrate. The radiating metal element comprises a radiating portion having a slit, a shorting portion having a first end electrically connected to the radiating portion and a second end electrically connected to the ground plane, and a feeding portion; the feeding portion comprises an antenna feeding point for electrically connecting to a signal source, wherein a first spacing is formed between the feeding portion and the radiating portion, and a second spacing is formed between the feeding portion and the shorting portion.

18 Claims, 6 Drawing Sheets

MULTIBAND ANTENNA

BACKGROUND OF THE INVENTION

1. Field of the Invention

The present invention relates to a multiband antenna, and more particularly, to a multiband shorted monopole antenna with a coupling feed.

2. Description of the Related Art

Recently, various kinds of wireless communication applications have emerged with the development and improvement of wireless communication technologies, such as notebook computers combined with wireless communication capabilities. Now notebook computers are mostly equipped with wireless local area network (WLAN) connection capabilities; however, in order to provide greater functionality, new notebook computers must provide antennas having multiband compatibilities to work with wireless applications such as wireless wide area network (WWAN) and world interoperability for microwave access (WiMAX). The WLAN antennas used in prior-art notebook computers are mostly inverted-F antennas, which bring challenges to engineers because of their size. In the prior art technique, such as that disclosed in the Taiwan patent no. 1293215 titled "Dual-Band Inverted-F Antenna", which discloses a dual-band antenna using dual resonant paths to achieve dual frequency band operations, the antenna is only suitable for WLAN operation; due to its large size, it is usually difficult to apply such an antenna to fit in a mobile communication device for WLAN/WMAX dual-network or multiband operation. Therefore, in view of the deficiencies of prior-art techniques, it is necessary to provide a multiband antenna suitable for mobile communication devices.

SUMMARY OF THE INVENTION

It is an object of the present invention to provide a multiband antenna which can operate in the frequency bands of WLAN and WiMAX simultaneously.

To achieve the above object, the present invention discloses a multiband antenna comprising: a ground plane; a substrate, and a radiating metal element. A side of the substrate is adjacent to a side of the ground plane; the radiating metal element is disposed on a surface of the substrate. The radiating metal element comprises a feeding portion, a radiating portion and a shorting portion. The radiating portion comprises a slit for exciting a rejected frequency band to generate a operating frequency band for the multiband antenna; one end of the shorting portion is electrically connected to the radiating portion and the other end of the shorting portion is electrically connected to the ground plane; the feeding portion is surrounded by the radiating portion, the shorting portion and the ground plane, wherein the feeding portion comprises an antenna feeding point for electrically connecting to a signal source; a first spacing is formed between the feeding portion and the radiating portion; and a second spacing is formed between the feeding portion and the shorting portion.

In one embodiment of the present invention, the multiband antenna uses a coupling feed structure to feed the electromagnetic energy from the feeding portion through the first spacing and the second spacing to generate multiple operation bands including a first (the lowest) operating frequency band, a second operating frequency band, and a third operating frequency band. The sum of the lengths of the shorting portion and the radiating portion is less than a quarter wavelength of a center frequency of the first (lowest) operating frequency band of the multiband antenna. Because the multiband antenna is formed on the substrate by etching or printing, the resonant length is shorter than a quarter wavelength of the center frequency of the first operating frequency band. Furthermore, a slit having a length close to a quarter wavelength of 4 GHz is inserted into the radiating portion so as to excite a rejected frequency band near 4 GHz, and to generate a new resonance point near 3.5 GHz (a zero point of the imaginary part of the impedance) to successfully create a new resonant mode covering the operating frequency band of 3.5 GHz WiMAX (the second operating frequency band of the multiband antenna). In addition, the new rejected frequency band has little effect on the first (2.5 GHz) and the third (5.5 GHz) operating frequency bands of the multiband antenna. The multiband antenna is operable in the 2.4/5.2/5.8 GHz WLAN (2400~2484/5150~5350/5725~5825 MHz) and the 2.5/3.5/5.5 GHz WiMAX (2500~2690/3400~3700/5250~5850 MHz) frequency bands and is able to achieve impedance matching in these operating frequency bands via suitable adjustment of the lengths of the first spacing and the second spacing. The multiband antenna can be implemented in a small size (about 9×13 $mm^2$) and embedded in notebook computers and mobile communication devices.

Hence, the present invention provides a multiband antenna with an innovative structure for various wireless communication applications.

DETAILED DESCRIPTION OF THE PREFERRED EMBODIMENT

The advantages and innovative features of the invention will become more apparent from the following detailed description when taken in conjunction with the accompanying drawings.

Figure 1:
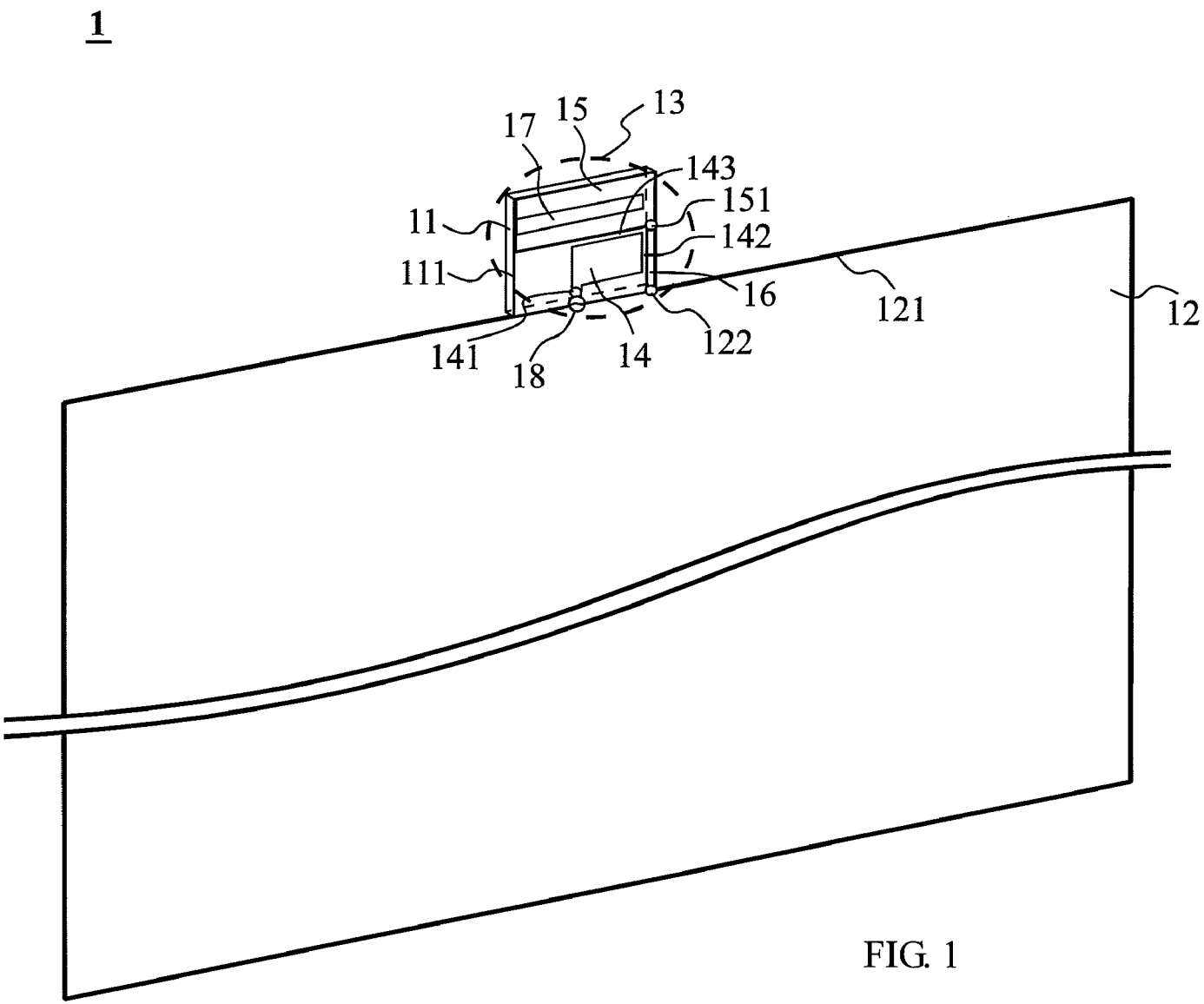
FIG. 1 illustrates a structural view of a first embodiment of the present invention.

FIG. 1 illustrates a structural view of a first embodiment of the present invention. The multiband antenna 1 comprises a substrate 11, a ground plane 12, and a radiating metal element 13. For example, the ground plane 12 can be, but is not limited to, a supporting metal plate of a display of a notebook computer or a system ground plane of a mobile communication device.

The radiating metal element 13 is formed on the surface 111 of the substrate 11 by etching or printing. In this embodiment, the substrate 11 is a dielectric substrate and has a side essentially adjacent to the center of a side 121 of the ground plane 12. However, the substrate and the ground plane can be connected with each other at any other position.

The radiating metal element 13 comprises a feeding portion 14, a radiating portion 15, and a shorting portion 16. The feeding portion 14 comprises an antenna feeding point 141 at one end for electrically connecting to a signal source 18. In this embodiment, the shape of the feeding portion 14 is slightly rectangular; the antenna feeding point 141 is a protruded stub and is at one end of the feeding portion 14. However, the shapes of the feeding portion 14 and the antenna feeding point 141 and the position of the antenna feeding point 141 on the feeding portion 14 can be varied in other embodiments.

A first spacing 143 is disposed between the feeding portion 14 and the radiating portion 15, and a second spacing 142 is disposed between the feeding portion 14 and the shorting portion 16. The values of the first spacing 143 and the second spacing 142 can affect the characteristics of the antenna's impedance matching; therefore, these two values need to be carefully chosen to obtain good antenna performance. In this embodiment, both the first spacing 143 and the second spacing 142 are less than 3 mm to provide enough capacitive coupling effect to achieve better operation in multiple frequency bands.

The radiating portion 15 can be, but is not limited to, slightly U-shaped.

The radiating portion 15 further comprises a slit 17 for additionally generating a resonance with high impedance characteristics to excite a rejected frequency band, thereby creating another operating frequency band for the multiband antenna 1. The length of the slit 17 is chosen to control the center frequency of the rejected frequency band, while the width of the slit 17 is used to adjust the bandwidth of the rejected frequency band. In this embodiment, the slit 17 is rectangular in shape; however, the slit 17 can be other shapes. Also in this embodiment, the slit 17 can generate a zero point of the imaginary part of the impedance and an additional resonant mode to meet the required frequency band of 3.5 GHz WiMAX operation.

One end of the shorting portion 16 is electrically connected to the connecting point 151 of the radiating portion 15 and the other end of the shorting portion is electrically connected to the shorting point 122 of the ground plane 12. The radiating portion 15 electrically connected to the ground plane 12 through the shorting portion 16 can reduce the impedance mismatch between the radiating portion 15 and the ground plane 12.

In addition, the sum of the length of the shorting portion 16 and the length of the radiating portion 15 is less than a quarter wavelength of the center frequency of the lowest operating frequency band of the multiband antenna 1.

Figure 2:
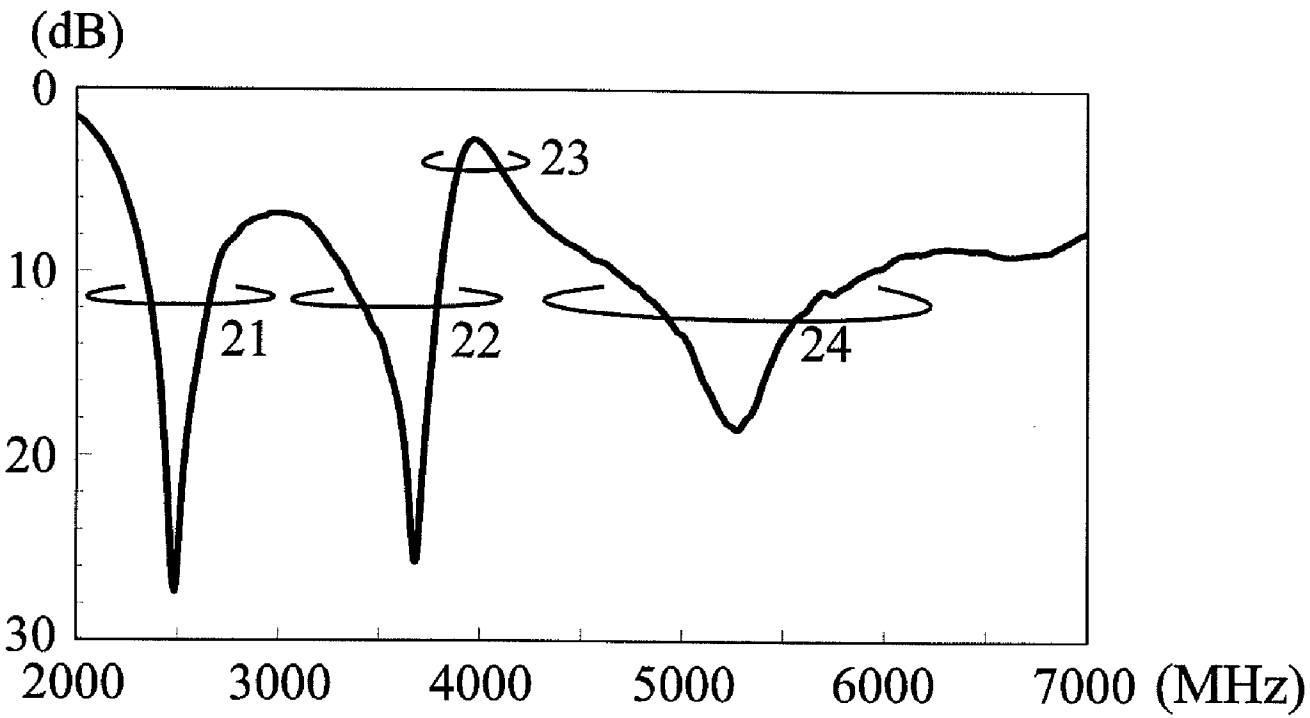
FIG. 2 illustrates a diagram of a measured return loss of the first embodiment of the present invention.

FIG. 2 illustrates a diagram of a measured return loss of the first embodiment of the present invention, wherein the X-axis represents the operating frequency and the Y axis represents the return loss. In this embodiment, the ground plane 12 is a supporting metal plate of a display of a notebook computer, measuring 260 mm long and 200 mm wide. The radiating metal element 13 is 13 mm long and 9 mm wide; the radiating metal element 13 is etched or printed on a fiberglass dielectric substrate 11 with a thickness of 0.8 mm. The radiating portion 15 of the radiating metal element 13 is 13 mm long and 4 mm wide; the slit 17 is about 12 mm long and 1 mm wide; the shorting portion 16 is 5 mm long and 0.5 mm wide; and the feeding portion 14 is 7 mm long and 3 mm wide. As shown in FIG. 2, around the second operating frequency 22 of the multiband antenna 1, the multiband antenna 1 has a rejected frequency band 23 located near 4 GHz and excited by the slit 17.

The first spacing 143 between the feeding portion 14 and the radiating portion 15 is about 1.0 mm; the second spacing 142 between the feeding portion 14 and the shorting portion 16 is about 1.0 mm. From the measured results shown in the figure, with a definition of 10 dB return loss, the first operating frequency band 21 of the multiband antenna 1 (which is the lowest operating frequency of the multiband antenna 1) covers the two operating frequency bands of 2.4 GHz WLAN/2.5 GHz WiMAX operations; the second operating frequency band 22 covers the operating frequency band of 3.5 GHz WiMAX operation; and the third operating frequency band 24 covers the three operating frequency bands of 5.2/5.8 GHz WLAN and 5.5 GHz WiMAX operations, for a total of six operating frequency bands.

Figure 3:
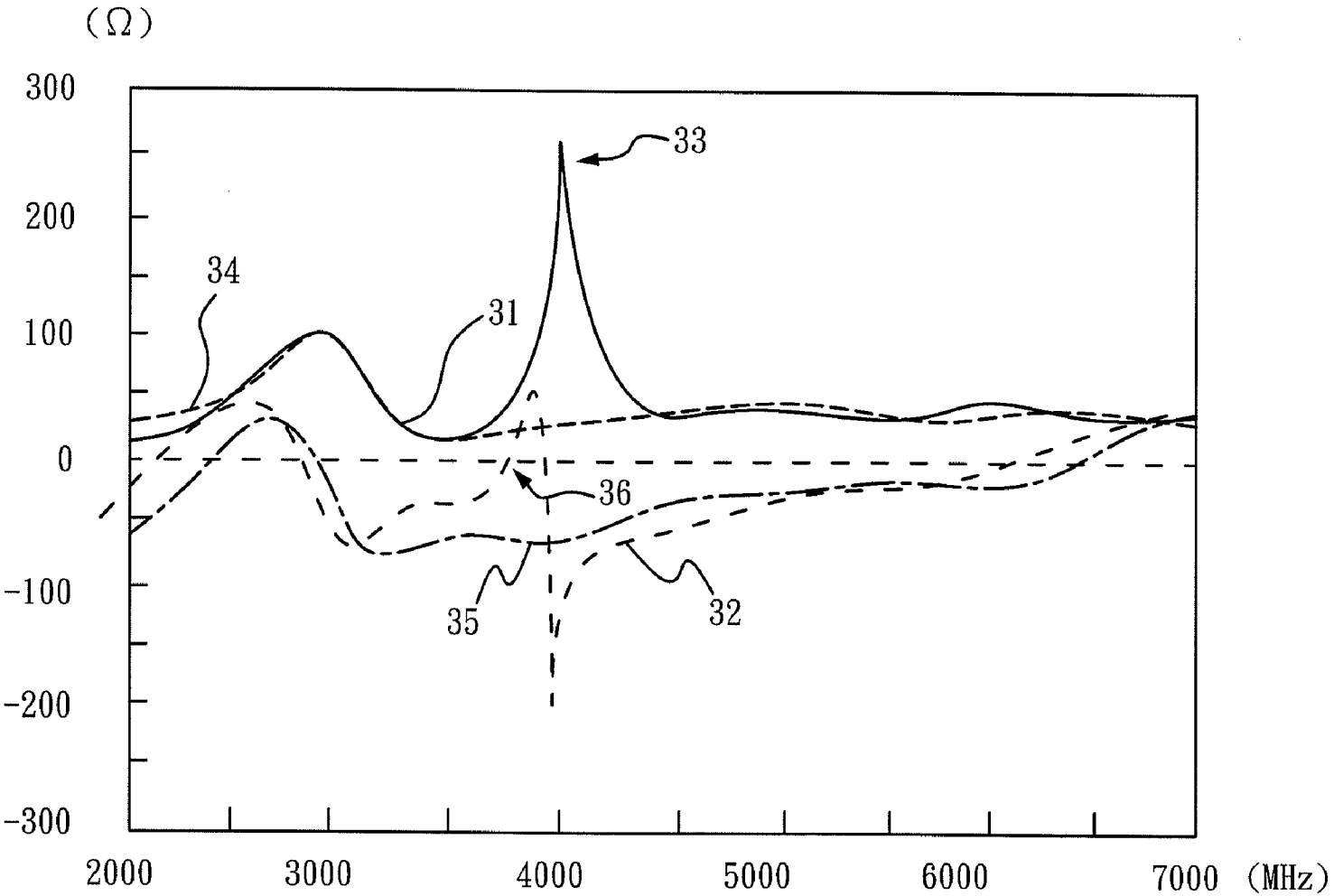
FIG. 3 illustrates a diagram of an input impedance of the first embodiment of the present invention.

FIG. 3 illustrates a diagram of an input impedance of the first embodiment of the present invention, wherein a real-part impedance curve of input impedance 31 and an imaginary-part impedance curve of input impedance 32 of the multiband antenna 1 are illustrated respectively; and a high impedance value 33 of the input impedance corresponding to the rejected frequency band 23 is shown in FIG. 2. Furthermore, in FIG. 3, a real-part impedance curve 34 and an imaginary-part impedance curve 35 when no slit is implemented are also illustrated for comparison; it can be observed that no high impedance value 33 is shown in FIG. 3 when no slit is implemented.

Also in FIG. 3, the center frequency of the rejected frequency band 23 corresponding to the high impedance value 33 is around 4 GHz, and a new resonance point 36 near 3.5 GHz (a zero point of the imaginary part of the impedance) is generated. The new rejected frequency band has little effect on the input impedance of the 2.5 GHz and 5.5 GHz operating frequency bands of the multiband antenna 1; therefore, the multiband antenna 1 is operational in the 2.4/5.2/5.8 GHz frequency bands of WLAN and the 2.5/3.5/5.5 GHz frequency bands of WiMAX. As shown in FIG. 2 and FIG. 3, the multiband antenna 1 provides advantages such as multiband operation, small size, and excellent antenna characteristics.

Figure 4:
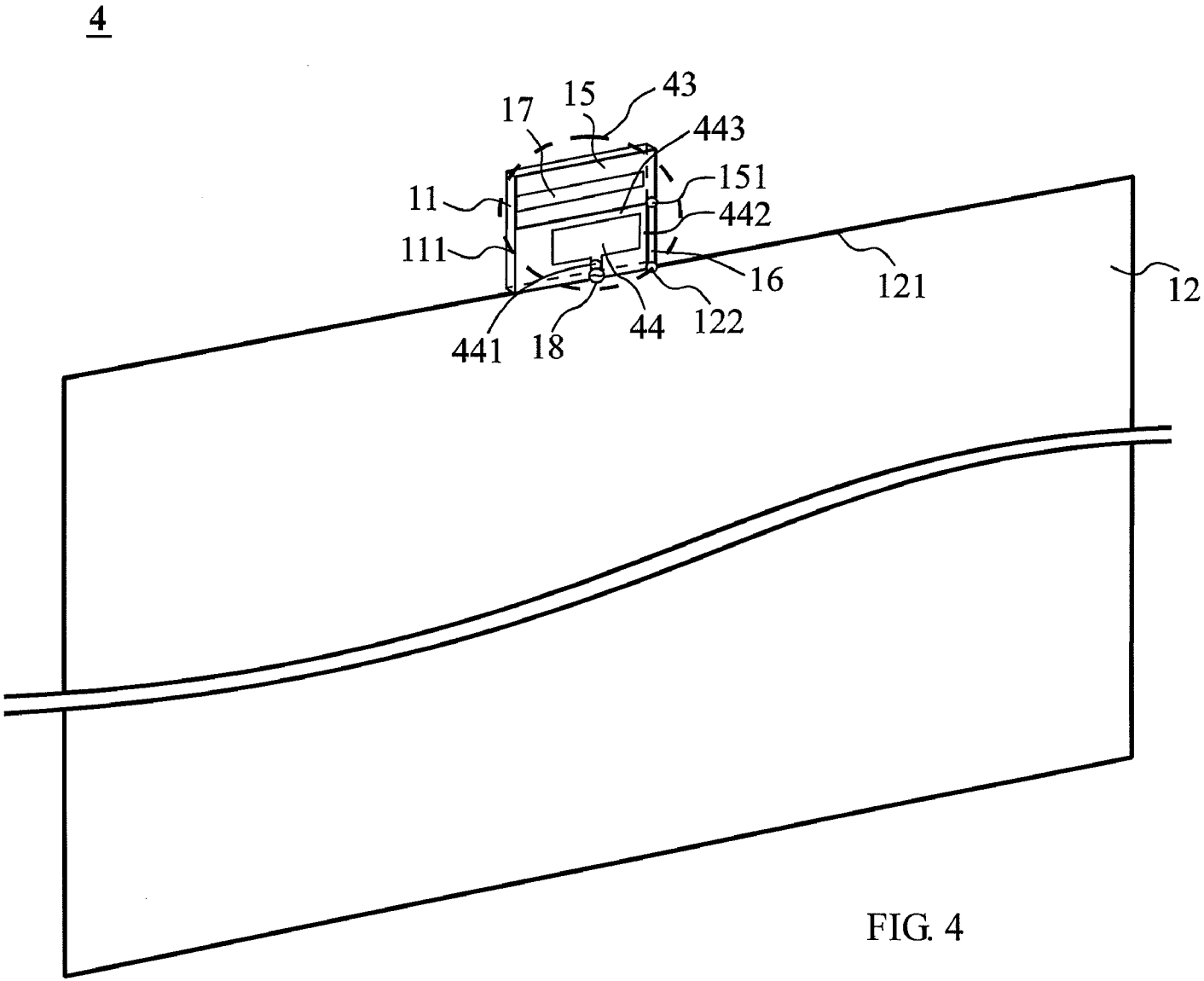
FIG. 4 illustrates a structural view of a second embodiment of the present invention.

Please refer to FIG. 4 for a structural view of a second embodiment of the present invention. The multiband antenna 4 comprises a substrate 11, a ground plane 12, and a radiating metal element 43. The radiating metal element 43 comprises a feeding portion 44, a radiating portion 15, and a shorting portion 16.

The difference between the second embodiment and the first embodiment is that the feeding portion 44 of the multiband antenna 4 is a symmetrical structure. The multiband antenna 4 can achieve impedance matching in its operating frequency band and an effect similar to that of the multiband antenna 1.

Figure 5:
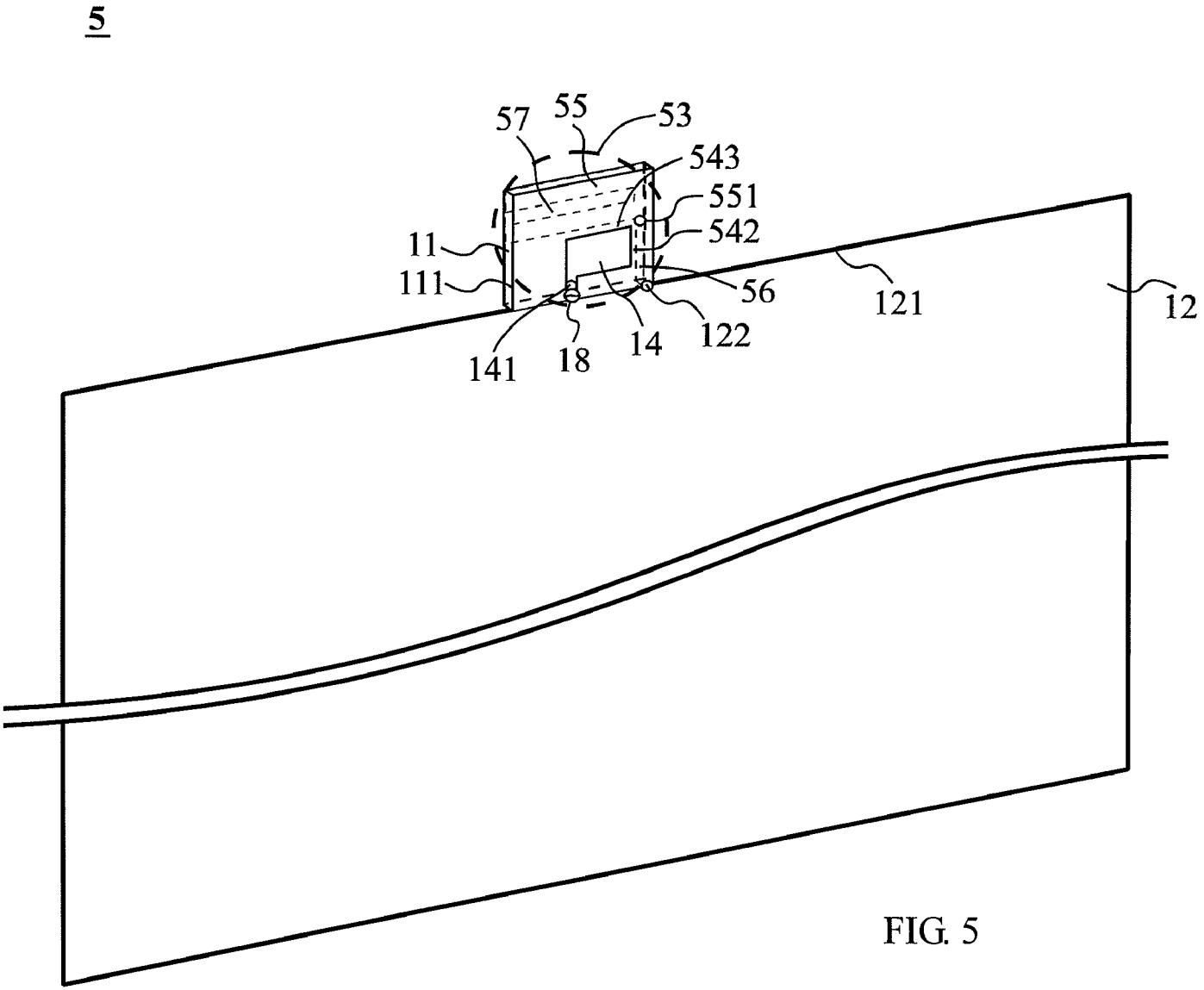
FIG. 5 illustrates a structural view of a third embodiment of the present invention.

Please refer to FIG. 5 for a structural view of a third embodiment of the present invention. The multiband antenna 5 comprises a substrate 11, a ground plane 12, and a radiating metal element 53. The radiating metal element 53 comprises a feeding portion 14, a radiating portion 55, and a shorting portion 56.

The difference between the third embodiment and the first embodiment is that the feeding portion 14 of the multiband antenna 5 is not on the same surface of the substrate 11 as the radiating portion 55 and the shorting portion 56. However, the multiband antenna 5 can also achieve an effect similar to that of the multiband antenna 1.

Figure 6:
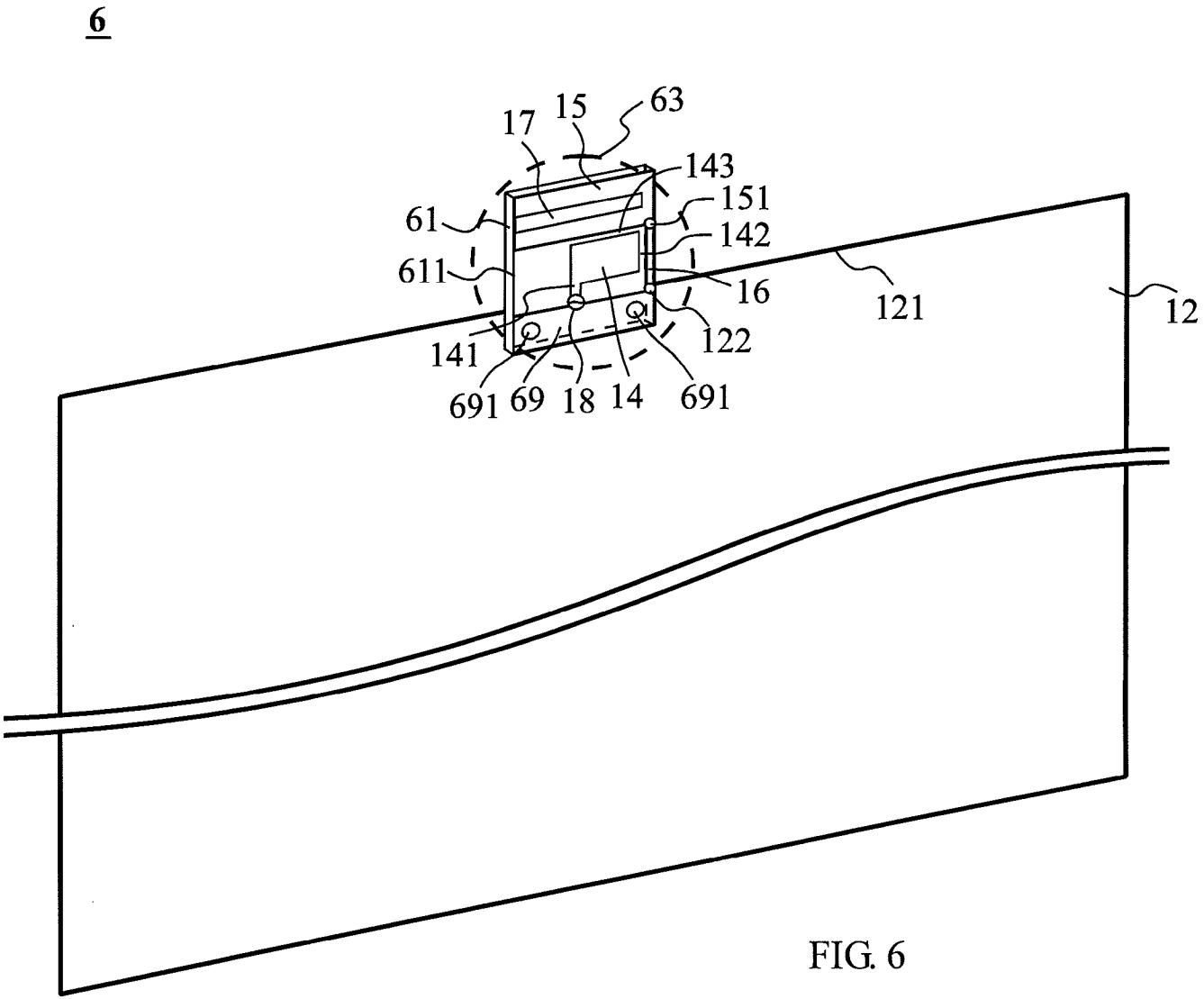
FIG. 6 illustrates a structural view of a fourth embodiment of the present invention.

Please refer to FIG. 6 for a structural view of a fourth embodiment of the present invention. The multiband antenna 6 comprises a substrate 61, a ground plane 12, and a radiating metal element 63. The radiating metal element 63 comprises an antenna ground plane 69, a feeding portion 14, a radiating portion 15, and a shorting portion 16.

The difference between the fourth embodiment and the first embodiment is that the substrate 61 is located near a side 121 of the ground plane 12 and a small portion of the substrate 61 overlaps the ground plane 12. The radiating metal element 63 can be fixed to the ground plane 12 through the antenna ground plane 69, and the antenna ground plane 69 electrically connects with the ground plane 12 via a through hole 691. One end of the shorting portion 16 is electrically connected to the connecting point 151 of the radiating portion 15, and the other end of the shorting portion 16 is connected to the antenna ground plane 69. Therefore, the feeding portion 14 is surrounded by the radiating portion 15, the shorting portion 16, and the antenna ground plane 69. Also, the multiband antenna 6 can achieve an effect similar to that of the multiband antenna 1.

Accordingly, the multiband antenna of the present invention is applicable for use as a multiband shorted monopole antenna with a coupling feed for a mobile communication device. It provides an operating frequency band that meets the requirements of all six frequency bands for 2.4/5.2/5.8 GHz WLAN and 2.5/3.5/5.5 GHz WiMAX operations. The design of the multiband antenna is implemented with a coupling feed to generate two broadband operating frequencies at 2.5 GHz and 5.5 GHz respectively and covers the operating frequencies of 2.4/5.2/5.8 GHz WLAN and 2.5/5.5 GHz WiMAX operations. Furthermore, a slit is inserted in the radiating portion and has a length chosen to be close to a quarter wavelength of 4 GHz; therefore, the slit can excite a rejected frequency band near 4 GHz. At the same time, the multiband antenna can generate a new resonance point near 3.5 GHz (a zero point of the imaginary part of the impedance) to successfully create a new resonant mode covering the operating frequency band of WiMAX (3.5 GHz). Besides, the new rejected frequency band has little effect on the original 2.5 GHz and 5.5 GHz operating frequency bands of the multiband antenna; therefore, the multiband antenna is operable in the 2.4/5.2/5.8 GHz frequency bands of WLAN and the 2.5/3.5/5.5 GHz frequency bands of WiMAX. The multiband antenna disclosed in the present invention has a simple structure and a smaller size ($9\times13$ mm$^2$ in the embodiment) compared with prior-art antennas; furthermore, it can easily be implemented on the substrate by etching or printing to reduce the manufacturing cost. Therefore, the multiband antenna can meet the requirements of new mobile communication devices.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A multiband antenna comprising:

a ground plane;

a substrate, the substrate having a side adjacent to a side of the ground plane; and a radiating metal element disposed on a surface of the substrate, the radiating metal element comprising:

a radiating portion having a slit for exciting a rejected frequency band to generate an operating frequency band for the multiband antenna;

a shorting portion having a first end electrically connected to the radiating portion and a second end electrically connected to the ground plane, wherein the sum of the lengths of the shorting portion and the radiating portion is less than a quarter wavelength of a center frequency of the lowest operating frequency band of the multiband antenna; and a feeding portion surrounded by the radiating portion, the shorting portion and the ground plane, wherein the feeding portion comprises an antenna feeding point for electrically connecting to a signal source; a first spacing is formed between the feeding portion and the radiating portion, and a second spacing is formed between the feeding portion and the shorting portion.

2. The multiband antenna as claimed in claim 1, wherein the ground plane is a supporting metal plate of a display of a notebook computer.

3. The multiband antenna as claimed in claim 1, wherein the ground plane is a system ground plane of a mobile communication device.

4. The multiband antenna as claimed in claim 1, wherein the substrate is a dielectric substrate.

5. The multiband antenna as claimed in claim 1, wherein the radiating metal element is formed on the substrate by etching or printing.

6. The multiband antenna as claimed in claim 1, wherein the first spacing is less than 3 mm.

7. The multiband antenna as claimed in claim 1, wherein the second spacing is less than 3 mm.

8. The multiband antenna as claimed in claim 1, wherein the multiband antenna is a multiband shorted monopole antenna with a coupling feed.

9. The multiband antenna as claimed in claim 1, wherein the radiating portion is in a U shape.

10. A multiband antenna comprising:

a ground plane;

a substrate, the substrate having a side adjacent to a side of the ground plane; and a radiating metal element disposed on a surface of the substrate, the radiating metal element comprising:

an antenna ground plane electrically connected to the ground plane;

a radiating portion having a slit for exciting a rejected frequency band to generate an operating frequency band for the multiband antenna;

a shorting portion having a first end electrically connected to the radiating portion and a second end electrically connected to the antenna ground plane, wherein the sum of the lengths of the shorting portion and the radiating portion is less than a quarter wavelength of a center frequency of the lowest operating frequency band of the multiband antenna; and a feeding portion surrounded by the radiating portion, the shorting portion and the antenna ground plane, wherein the feeding portion comprises an antenna feeding point for electrically connecting to a signal source; a first spacing is formed between the feeding portion and the radiating portion, and a second spacing is formed between the feeding portion and the shorting portion.

11. The multiband antenna as claimed in claim 10, wherein the ground plane is a supporting metal plate of a display of a notebook computer.

12. The multiband antenna as claimed in claim 10, wherein the ground plane is a system ground plane of a mobile communication device.

13. The multiband antenna as claimed in claim 10, wherein the substrate is a dielectric substrate.

14. The multiband antenna as claimed in claim 10, wherein the radiating metal element is formed on the substrate by etching or printing.

15. The multiband antenna as claimed in claim 10, wherein the first spacing is less than 3 mm.

16. The multiband antenna as claimed in claim 10, wherein the second spacing is less than 3 mm.

17. The multiband antenna as claimed in claim 10, wherein the multiband antenna is a multiband shorted monopole antenna with a coupling feed.

18. The multiband antenna as claimed in claim 10, wherein the radiating portion is in a U shape.

* * * * *